US009035770B2

(12) United States Patent
de Villiers

(10) Patent No.: US 9,035,770 B2
(45) Date of Patent: May 19, 2015

(54) ALARMED INTRUDER BARRIER

(76) Inventor: Marius de Wet de Villiers, Stellenbosch (ZA)

( * ) Notice: Subject to any disclaimer, the term of this patent is extended or adjusted under 35 U.S.C. 154(b) by 51 days.

(21) Appl. No.: 13/985,529

(22) PCT Filed: Nov. 30, 2011

(86) PCT No.: PCT/IB2011/002875

§ 371 (c)(1),
(2), (4) Date: Aug. 14, 2013

(87) PCT Pub. No.: WO2012/120329

PCT Pub. Date: Sep. 13, 2012

(65) Prior Publication Data

US 2013/0321151 A1 Dec. 5, 2013

(30) Foreign Application Priority Data

Mar. 10, 2011 (ZA) ..... 2011/01834

(51) Int. Cl.

| | |
|---|---|
| ***G08B 13/26*** | (2006.01) |
| ***G08B 13/12*** | (2006.01) |
| ***E06B 9/02*** | (2006.01) |
| ***G08B 13/04*** | (2006.01) |
| ***G08B 13/08*** | (2006.01) |
| ***E06B 9/01*** | (2006.01) |
| *E06B 9/00* | (2006.01) |

(52) U.S. Cl.
CPC . *G08B 13/12* (2013.01); *E06B 9/02* (2013.01); *E06B 2009/002* (2013.01); *G08B 13/04* (2013.01); *G08B 13/08* (2013.01); *E06B 9/01* (2013.01); *E06B 2009/015* (2013.01)

(58) Field of Classification Search
USPC ..... 340/561; 49/13, 57; 52/202; 160/236
See application file for complete search history.

(56) References Cited

U.S. PATENT DOCUMENTS 3,947,837 A 3/1976 Bitterice
4,345,635 A * 8/1982 Solomon ..... 160/133

(Continued)

FOREIGN PATENT DOCUMENTS

CN 201095942 Y 8/2008
CN 201162460 Y 12/2008

(Continued)

OTHER PUBLICATIONS

Espacenet, English abstract of CN 201095942 Y, Feb. 28, 2012.

(Continued)

*Primary Examiner* — John A Tweel, Jr.
(74) *Attorney, Agent, or Firm* — Cahn & Samuels, LLP

(57) ABSTRACT

An intruder barrier is provided that includes multiple generally parallel transparent slats acting as burglar bars with at least some, and preferably all, of the transparent slats having associated therewith a conductive path extending at least from a first end region of a slat to a second end region thereof. The conductive path is capable of conducting electricity or electromagnetic radiation along the length of the slat and is associated with an output to an alarm system that may be configured to trigger an alarm when the conductive characteristic of a slat is terminated by virtue of the slat being at least partially severed, broken, or removed from its operative position. Typically the transparent slats are secured to a fixed surrounding frame of an opening window. The invention in a further embodiment includes transparent slats for use in such an intruder barrier. The invention in a further embodiment includes a laterally collapsible latticed intruder barrier comprising multiple transparent slats interconnected with each other and having such conductive paths.

12 Claims, 5 Drawing Sheets

(56) References Cited

U.S. PATENT DOCUMENTS

| | | | | |
|---|---|---|---|---|
| 5,007,200 | A * | 4/1991 | Londono | 49/141 |
| 5,619,821 | A * | 4/1997 | St. George et al. | 49/57 |
| 2005/0230061 | A1* | 10/2005 | Wilkins | 160/172 R |
| 2009/0071082 | A1* | 3/2009 | Van Der Kort et al. | 52/202 |
| 2012/0055637 | A1* | 3/2012 | Marinetti et al. | 160/133 |
| 2012/0102856 | A1* | 5/2012 | Abruna et al. | 52/204.1 |

FOREIGN PATENT DOCUMENTS

| | | | |
|---|---|---|---|
| DE | 3832019 | A1 | 3/1990 |
| DE | 9300924 | U1 | 3/1993 |
| DE | 29516301 | U1 | 1/1996 |
| EP | 0087076 | A1 | 8/1983 |
| FR | 2885941 | A1 | 11/2006 |
| GB | 2194371 | A | 3/1988 |
| GB | 2287742 | A | 9/1995 |
| TW | 200837266 | | 9/2008 |

OTHER PUBLICATIONS

Espacenet, English abstract of CN 201162460 Y, Feb. 28, 2012.
Espacenet, English abstract of TW 200837266, Feb. 28, 2012.
Espacenet, English abstract of FR 2885940 A1, Feb. 28, 2012.
Espacenet, English abstract of DE 3832019 A1, Feb. 28, 2012.

* cited by examiner

ALARMED INTRUDER BARRIER

This application is the National Stage of International Application No. PCT/IB2011/002875, filed on Nov. 30, 2011, which claimed the benefit of South African Patent Application No. 2011/01834 filed Mar. 10, 2011, which are hereby both incorporated by reference. The International Application No. PCT/IB2011/002875 was published in English on Sep. 13, 2012.

FIELD OF THE INVENTION

This invention relates to an alarmed intruder barrier of the general type that may be used in relation to access openings such as windows and doors that provide access to premises including laterally collapsible latticed intruder barriers commonly used in association with doorways.

BACKGROUND TO THE INVENTION

Protecting premises against unauthorized entry by criminals is commonly achieved using fixed metal (usually steel or aluminum) burglar bars secured over windows as well as laterally collapsible latticed intruder barriers over doorways.

As regards windows, the windows themselves are commonly alarmed by way of magnetic switches that detect when a window is opened by virtue of the switch changing from an open to a close condition or vice versa, according to the type of alarm system that is employed.

The existing common arrangement has at least two main disadvantages, namely, the metal burglar bars are generally unsightly and impair the view through the window, and secondly there is generally no means of warning if a burglar bar has been cut or is otherwise tampered with whilst a window has been left open with the alarm inoperative by virtue of it being switched off to allow the window to be opened.

U.S. Pat. No. 3,947,837 has suggested a glass panel having an electrical conductor embedded therein such that an alarm can be triggered if the glass is broken. However, such an arrangement offers no protection whatsoever whilst the relevant window is left open and metal burglar bars would nevertheless need to be employed if a window is to be left open.

Applicant is unaware of any burglar alarms that have been integrated into a laterally collapsible latticed intruder barrier that is also unsightly and impairs the view through a doorway or window being protected.

SUMMARY OF THE INVENTION

In accordance with one aspect of this invention there is provided an intruder barrier characterized in that it comprises multiple generally parallel transparent slats acting as burglar bars and wherein at least some of the transparent slats have associated therewith a conductive path extending at least from a first end region of a slat to a second end region thereof wherein the conductive path is capable of conducting electricity or electromagnetic radiation along the length of a slat and wherein the ends of the conductive path are associated with an output to an alarm system that may be configured to trigger an alarm when the conductive characteristic of a slat is terminated by virtue of the slat being at least partially severed, broken, or removed from its operative position.

Further features of this aspect of the invention provide for the transparent slats to be secured to a fixed surrounding frame of an opening window; for all of the transparent slats to have with a conductive path associated therewith; for the conductive paths of the slats to be connected in series with each other and with an output to an alarm system; for the conductive path to be an electrically conductive path assuming the form of a wire; for the ends of each slat to be secured to a fixed frame by way of custom-made fittings secured to the surrounding frame, in use; and for the construction of each of the transparent slats to be substantially as defined in more detail below.

In accordance with a second aspect of the invention there is provided a transparent slat for use as a slat in an intruder barrier as defined above, the slat having a conductor applied to the slat so as to extend at least from a first end region to a second end region and wherein the conductor is capable of conducting electricity or electromagnetic radiation along its length, the conductor being either embedded within the material of which the slat is made or being secured thereto.

Further features of the second aspect of the invention provide for the conductor to be selected from an electrically conductive wire that is optionally located in a groove in a longitudinal edge of the slat, a conductive stripe applied to the surface of the slat and an optical fiber conductor; for the conductor to extend from a first end region of the slat to a second end region of the slat and back again to the first end region; and for a portion of the conductor where it is a separate item to extend away from the slat to form a loop that can be anchored to a frame or fitting secured to a frame.

Still further features of the second aspect of the invention provide for an electrically conductive wire, either with or without a layer of insulation thereon to be a press fitted in a groove extending along an edge of the slat; for this to be carried out by passing the slat with preformed grooves in the edge is thereafter edgewise on between nip rollers simultaneously with the wire being fed in line with the groove ahead of the rollers; and for the edges of the slats to be rounded off, at least to some extent.

In accordance with a third aspect of the invention there is provided a laterally collapsible latticed intruder barrier comprising multiple transparent slats interconnected with each other and wherein at least some of the transparent slats are provided with a conductive path as defined above.

Further features of the third aspect of the invention provide for the multiple transparent slats to be generally parallel slats interconnected by means of generally parallel flexible elements such as stainless steel cables; and for the generally parallel flexible elements to be, or to have accommodated therein, an elongate conductive element that may be connected into an alarm installation so as to trigger an alarm when the conductive element is severed.

The invention also provides an applicator accessory comprising a body supporting two relatively rotatable nip rollers defining between them a space slightly greater than the width of a transparent slat having grooves on one or both longitudinal edges such that passing a slat through the accessory causes an elongate conductive element of appropriate cross-sectional size to be forced into the or each groove to become press fitted therein.

In order that the above and other features of the invention may be more fully understood, various different embodiments of the invention will now be described with reference to the accompanying drawings.

DETAILED DESCRIPTION WITH REFERENCE TO THE DRAWINGS

Figure 1:
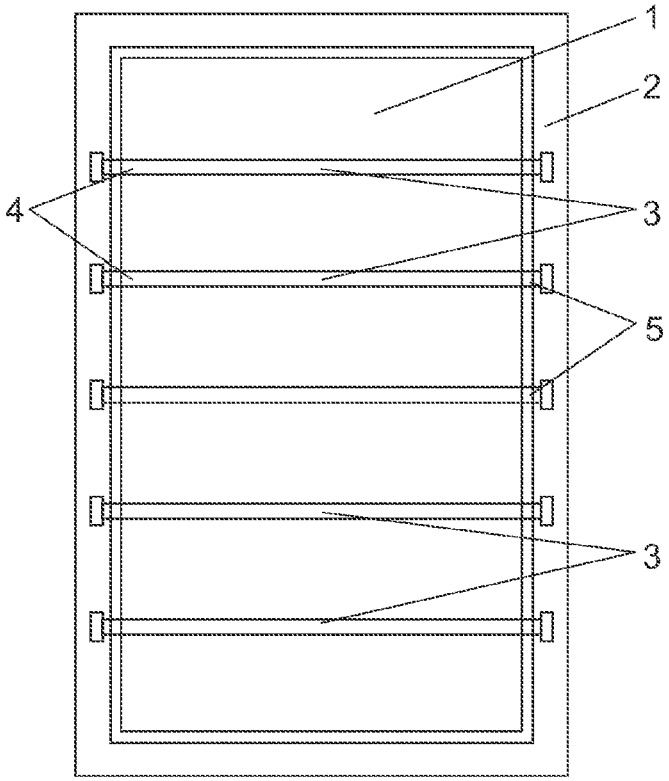
FIG. 1 is an elevation of a window fitted with an intrusion barrier according to the invention.
Figure 2:
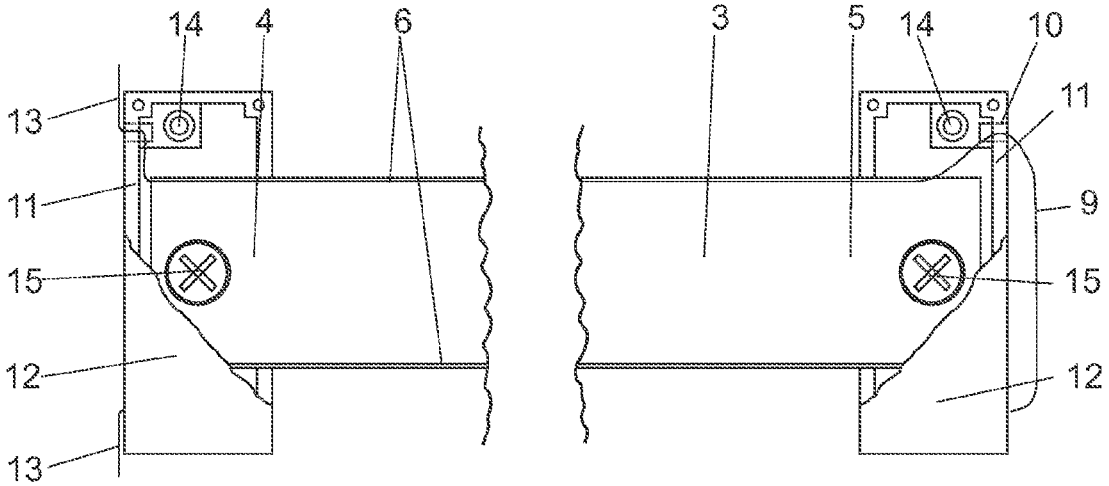
FIG. 2 is an enlarged elevation of the end regions of one slat showing a fitting whereby the slat is attached to a window frame with its cover partially broken away in each case.

In the embodiment of the invention illustrated in FIG. 1, an intruder barrier according to the invention is permanently fitted over an opening window (1) having a fixed surrounding window frame (2). The intruder barrier comprises a series of vertically spaced, generally parallel transparent slats (3) that act as burglar bars. The slats are preferably totally colourless so that they will obscure vision only to an extremely small extent, if at all. They are made of an extremely strong and tough plastics material such as a suitable polycarbonate. The spacing between the parallel slats is selected using similar constraints as are used in the construction of opaque metal burglar bars and the spacing is typically between about 100 and 150 mm. The width of the slats is conveniently about 30 mm although any appropriate width may be selected.

Each of the transparent slats has associated therewith a conductive path extending from a first end region (4) of the slat to a second end region (5) thereof and back again to the first end region. The conductor (6) is, in this instance, electrically conductive and is embedded within an adhesive sealant (7) in grooves (8) in the two longitudinal edges of the slat. The edges of the slats are suitably rounded in order to obviate any inadvertent injury that may be inflicted by a sharp edge.

A portion of the conductor extends away from the slat at the second end thereof to form a loop (9) that can be anchored to a frame or fitting secured to a frame by means of a fastener.

However, it is preferred that the conductor be threaded through apertures (10) of a custom-made fitting that is described below so that in the event that the end of the slat is removed from the fitting the conductor will become broken by virtue of it being anchored in position by the fitting and the alarm will be triggered.

The ends of each slat are, in this embodiment of the invention, secured to the fixed frame by way of a custom-made fitting comprising a base (11) secured, in use, to the surrounding frame and a cover (12) that clips on to the base. The base is arranged such that connecting wires (13) communicating with the conductors associated with the slats can pass through apertures in the side wall of the base so as to be led to a suitable alarm system that is further described below. A slat can therefore not be removed from the installed position without removing the fittings as well. Each of the bases of the fittings has two attachment lugs (14) for accommodating screws or other fasteners such as pop rivets, as may be appropriate, passing into the fixed frame.

A slat can therefore not be removed from the installed position at either end without breaking the conductor and triggering the alarm or without removing the fittings as well, which is extremely difficult, if not impossible, especially if suitable fasteners are used to attach the fittings. Each of the bases of the fittings has two attachment lugs (14) for accommodating screws or other fasteners such as pop rivets, as may be appropriate, passing into the fixed frame.

It is within the scope of this invention that the ends of the slats are simply held captive by the custom-made fittings. However, it is preferred that the ends of the slats are also secured to the frame directly by way of suitable fasteners (15) such as the Philips screws illustrated. Of course with a fixed frame of aluminum, pop rivets or other suitable fasteners could also be used.

It will be understood that the loop (9) of each conductor is also secured to the fixed frame by way of one or more of the fasteners so that the conductor will be broken if a slat is removed from its fitting.

Figure 4:
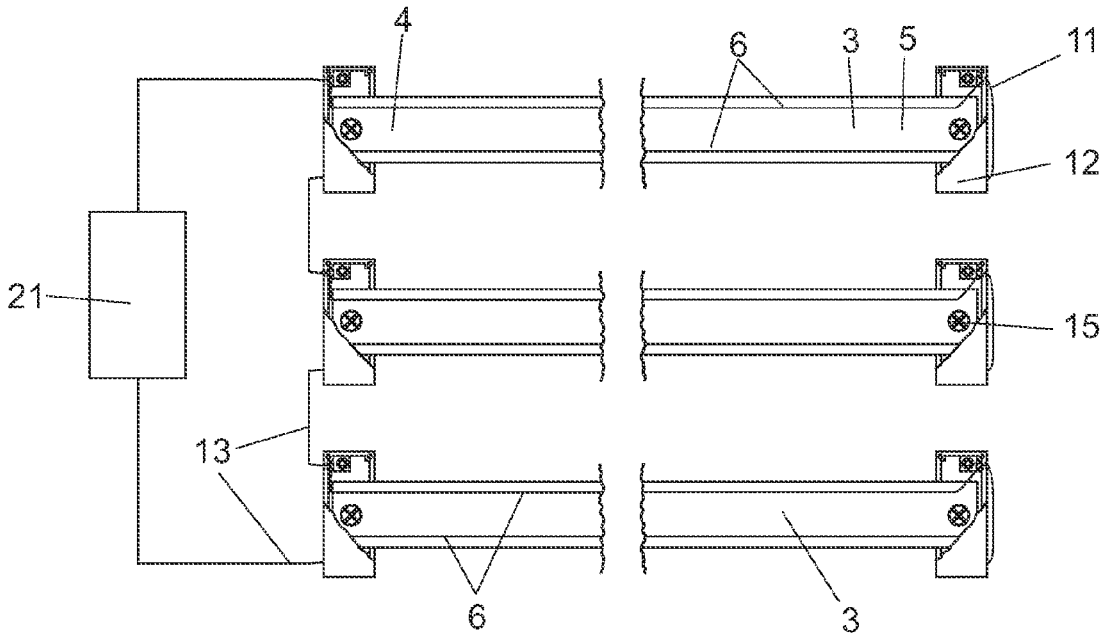
FIG. 4 is a schematic elevation showing one arrangement of transparent slats connected into an alarm system.

The conductors of the series of slats, three of which are shown in FIG. 4, are electrically connected in series with each other and with an output to an alarm system (21). The arrangement is such that each of the conductors has a resistor included in it that, in no manner, causes triggering of the alarm in the event that any bridging of one conductor to another is attempted. The alarm system is configured to trigger an alarm when the conductive characteristic of a slat ceases to be recognized by the series circuit by virtue of the fact that the relevant slat has been at severed to an extent that the conductor has been severed; a slat has been broken; or a slat has been removed from its operative position.

In operation, therefore, the opening window can be left open and the relevant alarm system can be left in an "on" condition. This being so, if there should be any tampering with the transparent slats in the manner indicated above, the alarm will be triggered.

The intruder barrier provided by the invention therefore provides an extremely unobtrusive, but highly effective, intruder barrier that enables an alarm to be left in an on condition whilst a window is open.

Numerous variations may be made to the embodiment of the invention described above without departing from the scope hereof.

Figure 5:
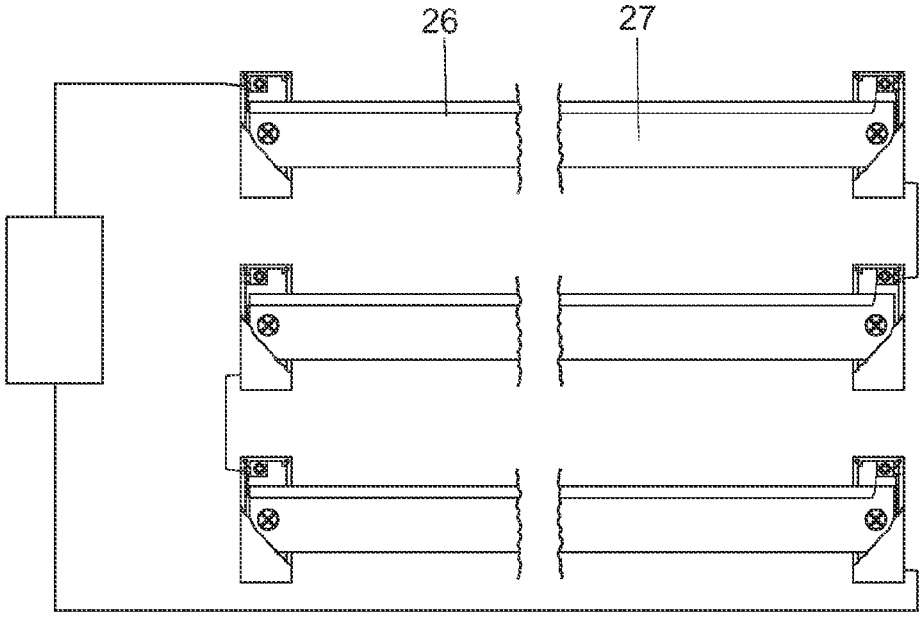
FIG. 5 is a similar elevation showing an alternative arrangement of transparent slats connected into an alarm system.

In particular, and as illustrated in FIG. 5, the conductors (26) may only extend from a first end region to a second end region of a slat (27) and not back to the first end region again. In such an instance of the conductors may still be connected in series with each other, as shown in FIG. 5.

Figure 6:
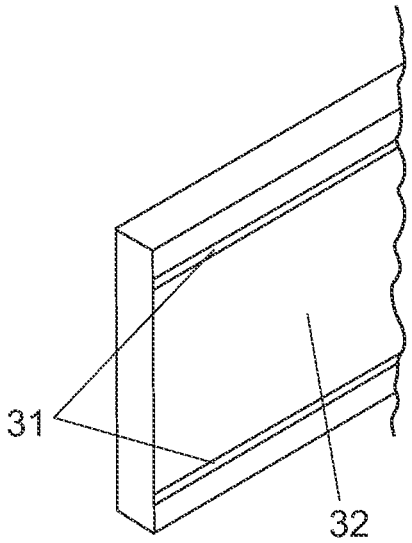
FIG. 6 is a view similar to FIG. 3 showing one alternative arrangement of conductor applied to a slat.

The way in which a conductor is attached to a slat may also be varied widely. Thus, as illustrated in FIG. 6, the conductive paths could be in the form of electrically conductive stripes (31) that may be printed onto the surface of the slat (32) or otherwise applied using adhesive.

Figure 7:
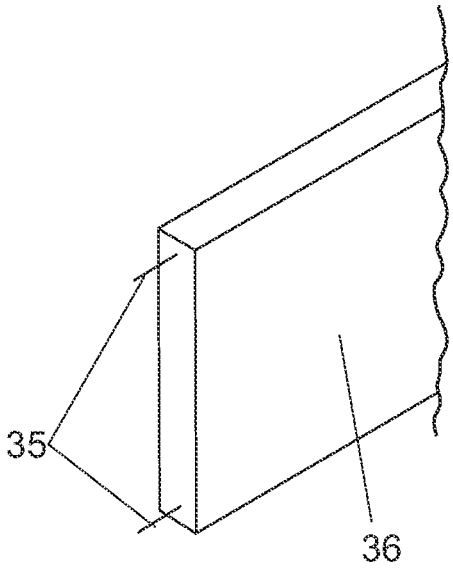
FIG. 7 is a view similar to FIG. 3 showing a second alternative arrangement of conductor within a slat.
Figure 8:
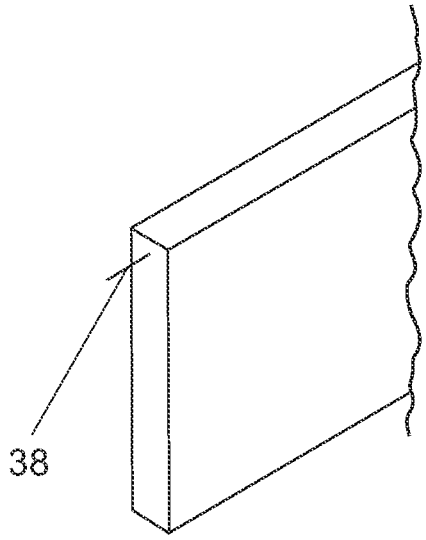
FIG. 8 is a view similar to FIG. 3 showing a third alternative arrangement of conductor within a slat.

Also, as illustrated in FIG. 7, conductors (35) could be molded into the interior of the plastic material of the slats (36) such as in an extrusion process. FIG. 8 shows a similar arrangement with a single conductor (38).

Figure 9:
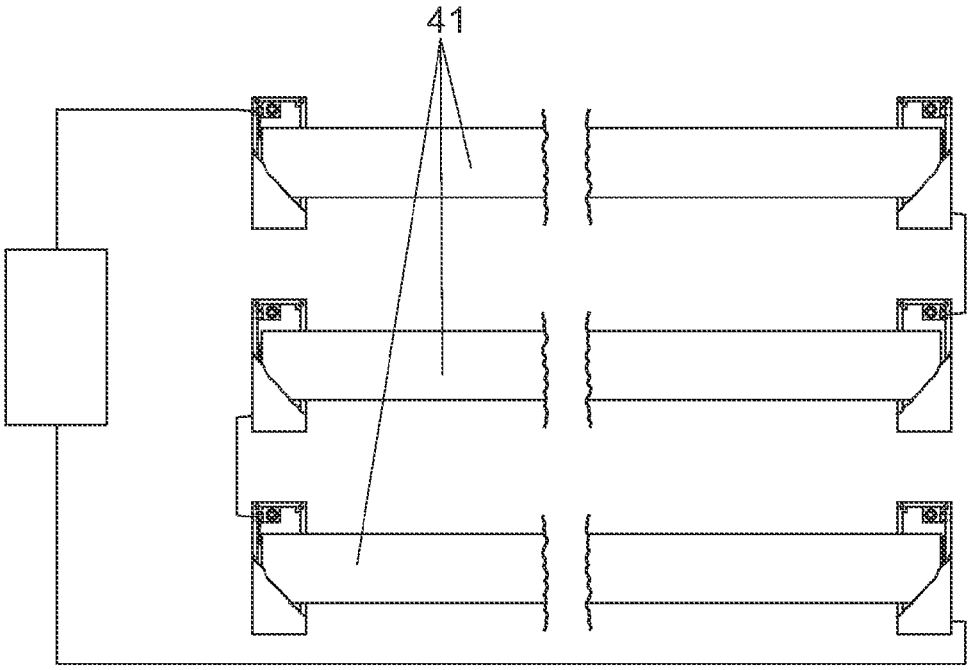
FIG. 9 is a schematic elevation similar to FIG. 4 of a further arrangement of transparent slats connected into an alarm system.

Indeed, it is also within the scope of this invention, and as illustrated in FIG. 9, that the slat (41) itself could serve as the conductive path for suitable electromagnetic radiation such as infrared radiation or the like that could be passed through the slat itself from one end to the other. In such an arrangement, the slats could be arranged in a series thereof so that any break in continuity associated with any one of the slats will give rise to a triggering of the alarm.

Of course, it is also within the scope of this invention that the conductive path of each transparent slat could be separately connected into an alarm system.

Figure 10:
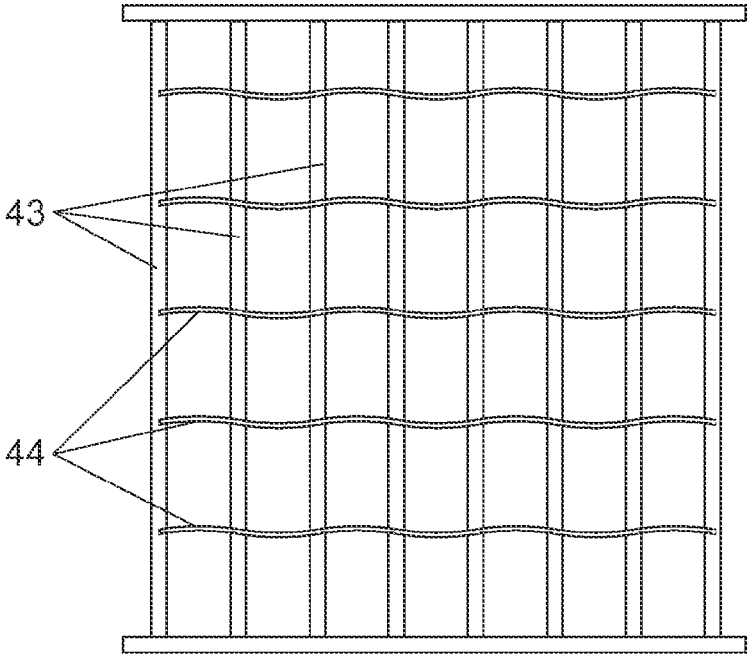
FIG. 10 is a schematic elevation of a laterally collapsible lattice intruder barrier; and, FIG. 11 is an elevation illustrating one form of slat and the way in which it can have its length trimmed to provide a desired length of slat.

The arrangement of slats can also be varied widely. Included within the scope of the invention is an intrusion barrier in the form of a laterally collapsible latticed intrusion barrier having multiple generally vertical transparent slats (43), as shown in FIG. 10. In such an instance conductors can be applied to the slats in any of the manners mentioned above. FIG. 10 also illustrates an arrangement in which the transparent slats are not secured directly to a surrounding frame by means of fasteners.

As the usual links are somewhat inappropriate to use on transparent slats, it is also proposed to interconnect the generally vertical transparent slats with flexible stainless steel cable (44) that can collapse as to the laterally collapsible intrusion barrier is opened. Also, these stainless steel cables may embody a conductor that can be included in an alarm system such that if any stainless steel cable is that, the alarm will be triggered.

Figure 11:
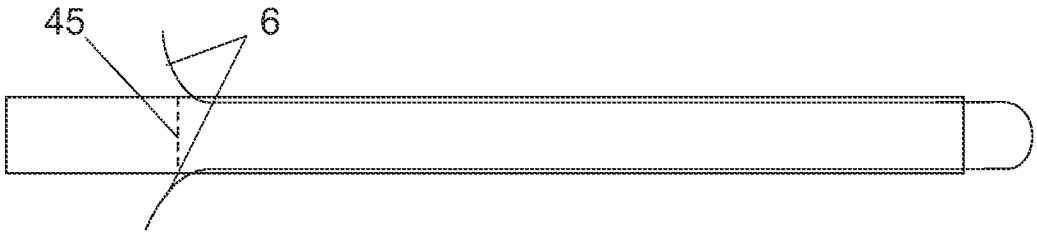

It is to be noted also that the invention is suitable for ease of installation and that the slats will be supplied in suitable standard lengths. A standard length, as illustrated in FIG. 11, can generally be arranged so that a portion of the length can be trimmed off at an appropriate position such as is indicated by the dotted line (45), in which instance the conductors are simply arranged accordingly, at least in appropriate circumstances.

Figure 3:
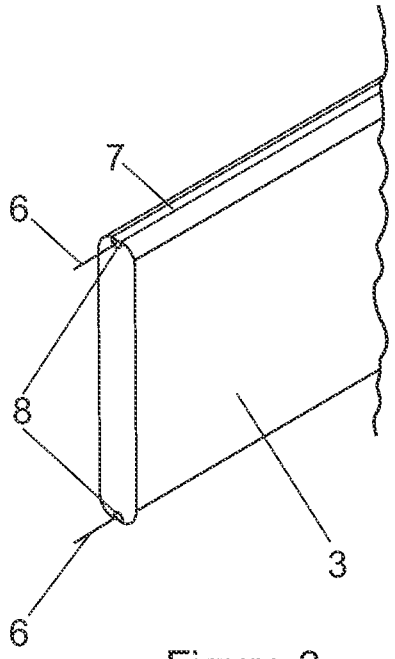
FIG. 3 is an isometric view of one end of a slat showing how the conductors are attached thereto.

Thus, in the instance of the conductors being located in grooves in the longitudinal edges of the slats in the manner described with reference to FIG. 3, the conductors (6) can be peeled out of the grooves for an appropriate length, as illustrated. The end can then be trimmed off using a suitable saw or the like. Holes can also be drilled through the slats as may be required for fixation using fasteners.

Figure 12:
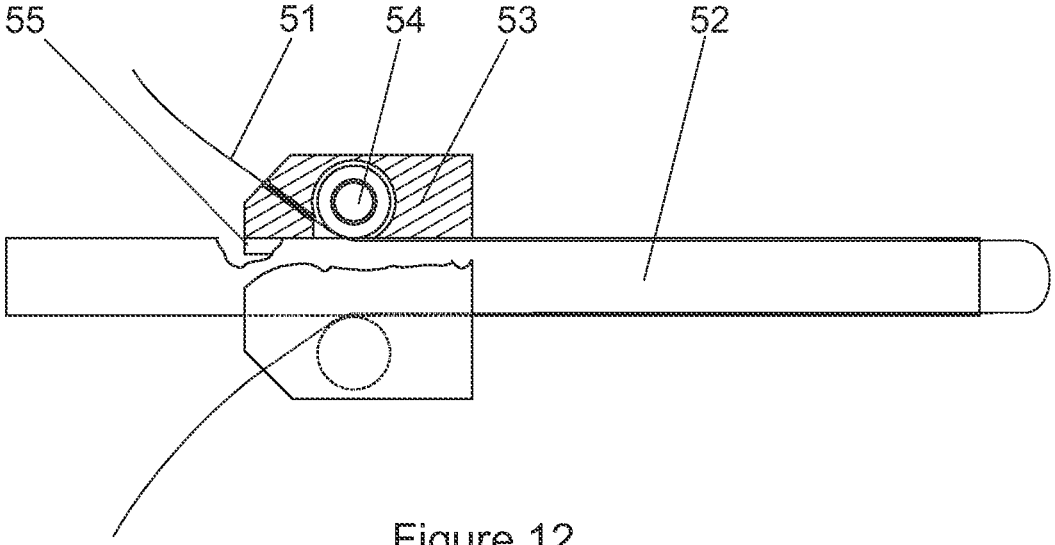
FIG. 12 is a partly broken away and schematic illustration of an applicator accessory for press fitting a conductor into a groove in an edge of a slat.

As an alternative to this procedure, a handheld or mounted applicator accessory that is illustrated schematically in FIG. 12, may be provided for press fitting conductors (51), either with or without insulation over the conductors, into preformed grooves in the edges of a custom length slat (52), on-site. The applicator accessory comprises a body (53) supporting two relatively rotatable nip rollers (54) that can typically be roller bearings, for example and that define between them a space slightly greater than the width of a transparent slat having grooves on one or both longitudinal edges. The space is selected such that passing a slat through the accessory and simultaneously feeding conductor onto the opening to each groove, causes the elongate conductive element of appropriate cross-sectional size to be forced into the or each groove to become press fitted and consequently retained therein. The passage through the body for receiving a slat past therethrough is of a squat channel shape with inwardly directed lips (55) that prevent the slat from the sting out of its flat condition in a plane at generally right angles to the axes of rotation of the rollers.

It will be understood that by using an applicator accessory of this nature, which is extremely simple, the slats can be cut from longer lengths at an installation site and the conductors can only then be installed in the grooves in the edges of custom length slats.

It will also be understood that, at least for the most part, the description applied to electrically conductive conductors applies equally well to optical fibers with appropriate changes to the sensing mechanisms.

However, in the instance of electrically conductive conductors that have no outer installation so as to provide an exposed electrically conductive surface, it is also possible to change these wires with a high-voltage charge of a general nature used in well-known electric fences so that if touched they will discharge and, unless the person touching them is adequately protected, impose an electrical shock on such a person. The high-voltage charge may be provided by a high voltage generator. The sudden discharge of the conductors may be configured to trigger an alarm.

The invention therefore provides a simple yet highly effective intruder barrier that is unobtrusive when it is in its operative position; can remain in operation whilst an associated alarm system is in the "on" condition; and interferes with any view only minimally.

The invention claimed is:

1. An intruder barrier comprising:

multiple generally parallel transparent slats acting as burglar bars, wherein at least some of the transparent slats have associated therewith a conductive path extending at least from a first end region of the slat to a second end region thereof wherein the conductive path is capable of conducting electricity or electromagnetic radiation along the length of the slat, and wherein the ends of the conductive path are associated with an output to an alarm system that may be configured to trigger an alarm when the conductive characteristic of the slat is terminated by virtue of the slat being at least partially severed, broken, or removed from its operative position.

2. The intruder barrier as claimed in claim 1, wherein the transparent slats are secured to a fixed surrounding frame of an opening window.

3. The intruder barrier as claimed in claim 1, wherein each of the transparent slats has a conductive path associated therewith.

4. The intruder barrier as claimed in claim 1, wherein the conductive paths of the slats are connected in series with each other and with an output to an alarm system.

5. The intruder barrier as claimed in claim 1, wherein the conductive path is an electrically conductive path assuming the form of an electrically conductive wire.

6. The intruder barrier as claimed in claim 1, wherein the conductive path includes a conductor is selected from an electrically conductive wire that is optionally located in a groove in a longitudinal edge of the slat, a conductive stripe applied to the surface of the slat, and an optical fiber conductor.

7. The intruder barrier as claimed in claim 1, wherein the conductive path includes a conductor that extends from the first end region of the slat to the second end region of the slat and back again to the first end region.

8. The intruder barrier as claimed in claim 1, wherein the transparent slats have a conductor applied to the slat so as to extend at least from the first end region to the second end region, and wherein the conductor is capable of conducting electricity or electromagnetic radiation along its length, the conductor being either embedded within the material of which the slat is made or being secured thereto.

9. The intruder barrier as claimed in claim 1, further comprising multiple transparent slats interconnected with each other in a laterally collapsible lattice, and wherein at least some of the transparent slats are provided with the conductive path.

10. The intruder barrier as claimed in claim 1, wherein the transparent slats include a conductor that extends away from the slat to form a loop that can be anchored to a frame or fitting secured to a frame.

11. The intruder barrier as claimed in claim 1, further comprising multiple transparent slats interconnected with each other in a laterally collapsible lattice, and wherein each of the transparent slats are provided with the conductive path.

12. The intruder barrier as claimed in claim 1, further comprising multiple transparent slats interconnected with each other in a laterally collapsible lattice, and wherein each of the transparent slats are provided with the conductive path, and the conductive path includes a conductor selected from an electrically conductive wire that is optionally located in a groove in a longitudinal edge of the slat, a conductive stripe applied to the surface of the slat, and an optical fiber conductor.

* * * * *